US007190924B2

(12) United States Patent
Watanabe et al.

(10) Patent No.: US 7,190,924 B2
(45) Date of Patent: Mar. 13, 2007

(54) IMAGE FORMING APPARATUS THAT ELIMINATES THE INADVERTENCE OF MIXED COLOR TONERS AND IMAGE FORMING METHOD

(75) Inventors: Takeshi Watanabe, Kanagawa-ken (JP); Masashi Hiroki, Kanagawa-ken (JP); Masashi Takahashi, Kanagawa-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/946,377

(22) Filed: Sep. 22, 2004

(65) Prior Publication Data

US 2005/0069355 A1 Mar. 31, 2005

(30) Foreign Application Priority Data

Sep. 30, 2003 (JP) ..... 2003-340902

(51) Int. Cl.
*G03G 15/08* (2006.01)

(52) U.S. Cl. ..... 399/257

(58) Field of Classification Search ..... 399/359, 399/343, 358

See application file for complete search history.

(56) References Cited

U.S. PATENT DOCUMENTS

| | | | | |
|---|---|---|---|---|
| 4,614,165 A | | 9/1986 | Folkins et al. | |
| 4,727,395 A | | 2/1988 | Oda et al. | |
| 4,843,424 A | | 6/1989 | Oda et al. | |
| 5,436,700 A | | 7/1995 | Kikuchi et al. | |
| 5,455,666 A | * | 10/1995 | Saito et al. | 399/359 |
| 5,797,070 A | | 8/1998 | Waki et al. | |
| 6,006,055 A | | 12/1999 | Furuya | |
| 6,332,063 B1 | | 12/2001 | Ozawa et al. | |
| 6,438,343 B1 | | 8/2002 | Inoue | |
| 6,496,673 B2 | | 12/2002 | Bessho | |

FOREIGN PATENT DOCUMENTS

| | | | |
|---|---|---|---|
| JP | 2-21591 B2 | | 5/1990 |
| JP | 04037781 A | * | 2/1992 |
| JP | 8-137174 A | | 5/1996 |
| JP | 8-328344 A | | 12/1996 |
| JP | 10026869 A | * | 1/1998 |
| JP | 2000-235311 A | | 8/2000 |
| JP | 2000-298388 A | | 10/2000 |
| JP | 2000-321875 A | | 11/2000 |
| JP | 3126523 B2 | | 11/2000 |
| JP | 2001-42594 A | | 2/2001 |
| JP | 2001117365 A | * | 4/2001 |
| JP | 2001-337548 A | | 12/2001 |

* cited by examiner

*Primary Examiner*—Quana Grainger
(74) *Attorney, Agent, or Firm*—Foley & Lardner LLP

(57) ABSTRACT

In an image forming apparatus using the cleaner-less processing, a developer vent is provided to a developing device so as to discharge paper dust mixing in the developing device together with developer comprising carrier and toner or carrier only through the developer vent, when removing residual toner.

20 Claims, 10 Drawing Sheets

IMAGE FORMING APPARATUS THAT ELIMINATES THE INADVERTENCE OF MIXED COLOR TONERS AND IMAGE FORMING METHOD

CROSS-REFERENCE TO RELATED APPLICATIONS

This application is based upon and claims the benefit of priority from prior Japanese Patent Application No. 2003-340902, filed Sep. 30, 2003; the entire contents of which are incorporated herein by reference.

BACKGROUND OF THE INVENTION

1. Field of the Invention

The present invention relates to an image forming apparatus that uses two-component developer comprising toner and carrier and an image forming method.

2. Description of the Related Art

An image forming technology utilizing a cleaner-less process is widely known and practically used. In this cleaner-less process, a developing device recovers residual toner on a photosensitive drum. However, paper powder of transfer materials and peripheral dust are also recovered, causing such a trouble that they are mixed into developer in a developing device. As a countermeasure to this problem, a technology to get a clear image without being affected by powder of transfer materials using developer after mixing with the recovered powder and stirring the mixture thoroughly for the image forming is disclosed in Japanese Published Patent Application No. 2000-321875.

However, when paper dust mixed in developer is increasing, even when dispersed in a developing device, developer deteriorated and in mixed colors may adversely affect an image. It is therefore necessary for continuously forming clear images to prevent paper dust from mixing in developer or to eliminating mixed paper dust.

SUMMARY OF THE INVENTION

It is an object of the present invention to provide an image forming apparatus and an image forming method capable of continuously forming clear images by sufficiently and efficiently eliminating toners mixed with paper dust or other color toners mixed in a developing device of an image forming apparatus for forming images using two-component developer and utilizing a cleaner-less process.

According to an aspect of the present invention, an image forming apparatus is provided, which comprises an image carrier; a main charger to uniformly charge the image carrier; an exposure unit to form an electrostatic latent image by exposing the image carrier charged by the main charger; a developing device, having a developer vent and a developer replenishing port to replenish developer to the developing device, to form a toner image by developing the electrostatic latent image on the image carrier with two-component developer including toner and carrier; and a transfer unit to transfer the toner image onto an image receiving medium, wherein the developing device removes residual toner remained on the image carrier after transferring the toner image by the transfer unit and discharges paper dust mixed into the developing device when removing the residual toner through the developer vent together with the carrier.

Further, according to an aspect of the present invention, an image forming method is provided, which comprises uniformly charging an image carrier; forming an electrostatic latent image by exposing the charged image carrier; forming a toner image by developing the electrostatic latent image using two-component developer including toner and carrier by a developing device having a developer vent; transferring the toner image onto an image receiving medium; and removing residual toner remaining on the surface of the image carrier after transferring the toner image and discharging paper dust mixed in the developing device when removing the residual toner together with developer or the carrier through the developer vent.

DETAILED DESCRIPTION OF THE INVENTION

Figure 1:
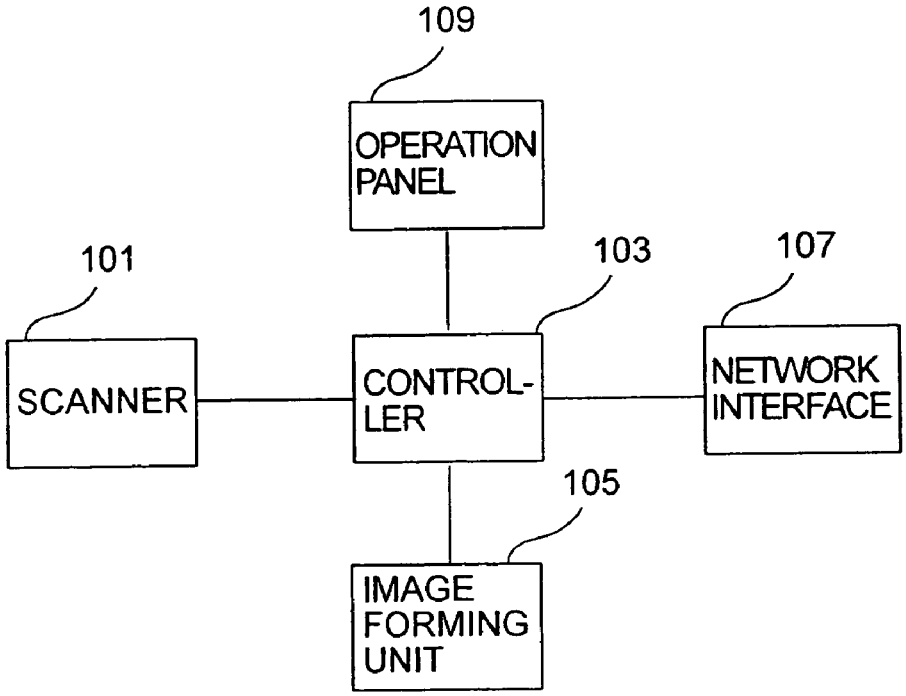
FIG. 1 is a block diagram showing an embodiment of the image forming apparatus of the present invention.

A first embodiment of the present invention will be explained below referring to the attached drawings. FIG. 1 is a block diagram of an image forming apparatus. A document image is read by a scanner 101 and image data generated based on color data of red, green and blue of the document image is sent to a controller.

Controller 103 controls the operation of the image forming apparatus and further, executes the image data processing and the dimensional computation of respective color images that are formed in the respective processing units which are described later.

Controller 103 is connected with a network interface 107 which is connected to external networks including LAN and Internet and receives image data/instructions relative from the external activities and sends out the status information of the image forming apparatus to the external activities.

Further, controller 103 is connected with an operation panel 109 attached to the image forming apparatus and through which instructions relative to the operation of the image forming apparatus may be obtained.

Further, controller 103 is connected with an image forming unit 105 and a toner image is formed on a paper based on image data.

Figure 2:
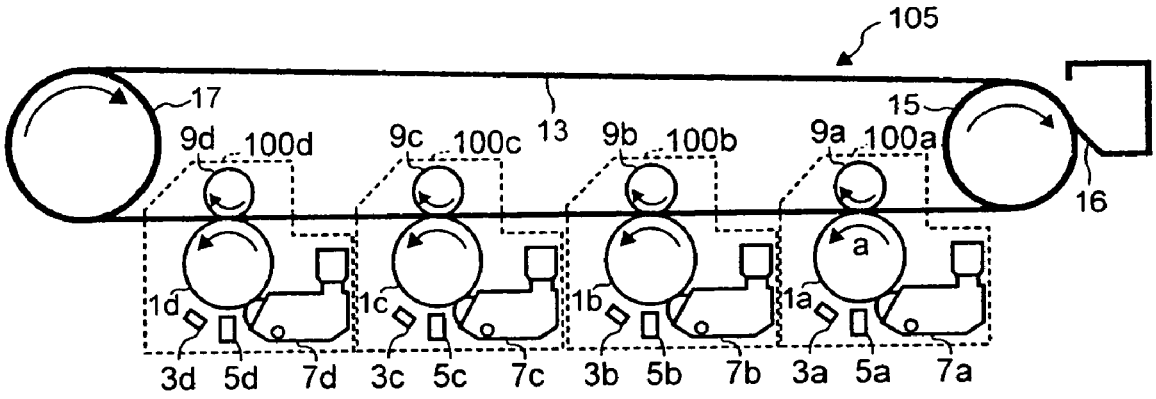
FIG. 2 is a schematic diagram showing an image forming unit of the image forming apparatus shown in FIG. 1.

FIG. 2 is a schematic diagram of image forming unit 105. Image forming unit 105 is equipped with a first processing unit 100*a* to form yellow toner images, a second processing unit 100*b* to form magenta toner images, a third processing unit 100*c* to form cyanic toner images, a fourth processing unit 100*d* to form black toner images, and a conveyor belt 13 to convey paper.

Conveyor belt 13 is rotated by a driven roller 15 and a drive roller 17. For conveyor belt 13 to convey paper from the upstream side to the downstream sir by rotating, first processing unit 100*a*, second processing unit 100*b*, third processing unit 100*c* and fourth processing unit 100*d* are arranged from the upstream side.

Conveyor belt 13 is rotated at a velocity almost equal to the peripheral velocity of a photosensitive drum 1*a*. A belt cleaner 16 for removing toners adhered to conveyor belt 13 is provided at the downstream side from forth processing unit 100*d* but at the upstream side from first processing unit 100*a* in the rotating direction of conveyor belt.

In this embodiment, all processing units are in the same structure and therefore, the structure of first processing unit 100*a* will be described as a representative example.

First processing unit 100*a* is composed of photosensitive drum 1*a*, a main charger 3*a*, an exposure unit 5*a*, a developing device 7*a*, and a transfer unit 9*a*.

Photosensitive drum 1*a* which is a first image carrier is a cylindrical laminated type organic photo conductor. This photosensitive drum 1*a* rotates in sync with the peripheral velocity of conveyor belt 13 in the arrow direction a in the figure. Around photosensitive drum 1a, main charger 3*a*, exposure unit 5*a*, developing device 7*a* and transfer unit 9*a* are arrange in order in the rotating direction of photosensitive drum 1*a*.

Main charger 3*a* is opposing to photosensitive drum 1*a* and minus charges the surface of photosensitive drum 1*a* by corona discharge. Exposure unit 5*a* equipped with such a light emitter as LED is opposing to the part of photosensitive drum 1*a* charged by main charger 3*a*, exposes and forms an electrostatic latent image thereon when photosensitive drum 1*a* is rotated. Developing device 7*a* is opposed to the part of photosensitive drum 1*a* exposed by exposure unit 5*a* when photosensitive drum 1*a* is rotated and develops the electrostatic latent image to a toner image. At the position where the toner image of the electrostatic latent image developed by developing device 7*a* is opposed to a paper conveyed by conveyor belt 13, transfer unit 9*a* electrically sucks in the toner image from the reverse side of conveyor belt 13 and transfers it on the paper.

Figure 3:
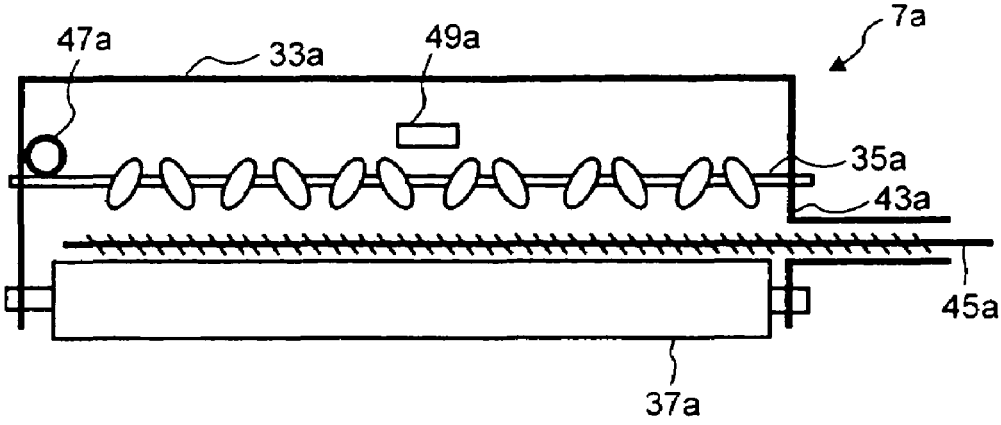
FIG. 3 is a sectional view when viewed from above of the developing device that is used in the image forming unit shown in FIG. 2.

Developing device 7*a* will be described below in detail. FIG. 3 is a diagram showing the rough sectional view of developing device 7*a* viewed from above. Developing device 7*a* has a developer container 33*a* containing developer comprising toner and carrier. In the inside of developer container 33, an agitating roller 35*a* is provided to agitate toner.

Toner is taken out from developer container 33*a* and an electrostatic latent image is developed by a developing roller 37*a* that is composed of a magnet roller and provided along the lateral direction of developer container 33*a*. Toner density of developer in developing container 33*a* is monitored by a toner density detector 49*a* comprising a magnetic sensor/optical sensor.

Figure 4:
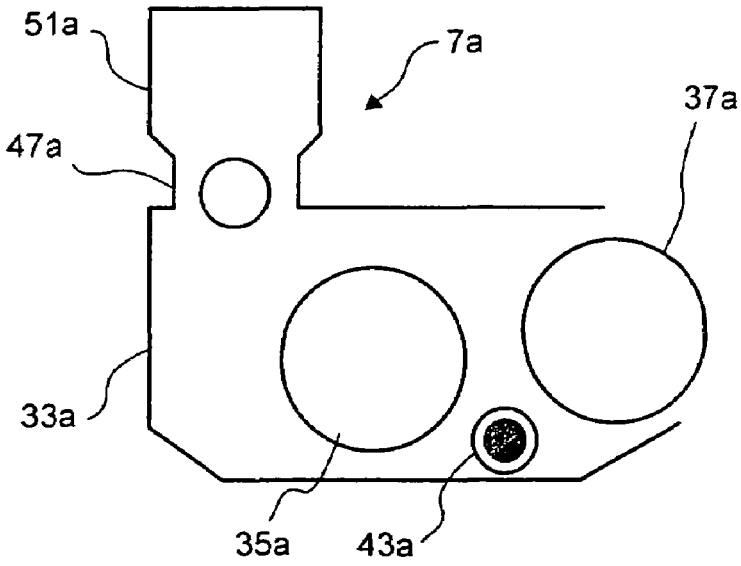
FIG. 4 is a schematic sectional viewed when viewed from the left of the developing device shown in FIG. 3.

As shown in the rough sectional view of developing device 7*a* viewed from the left in FIG. 4, a developer vent 43*a* is provided on the side of developer container 33*a* and developer in developer container 33*a* is conveyed to this developer vent 43*a* when an auger 45*a* provided parallel to developing roller 37*a* is rotated. Further, there is provided a developer replenishing port 47*a* on the top of developer container 33*a* and developer can be replenished into developer container 33*a* from a developer cartridge 51*a*.

When toner is consumed by the development and atoner density detector detects that toner density dropped below a specified density, auger 45*a* rotates and discharges developer in developing container 33*a* through developer vent 43*a* and developer is replenished from developer replenishing port 47*a*.

The image forming operation of an image forming apparatus equipped with first processing unit 100*a* equipped with developing device 7*a* in the structure described above and second to fourth processing units 100*b* to 100*d* which are in the similar structure as first processing unit 100*a* will be explained referring to FIG. 5 to FIG. 13.

FIG. 5 to FIG. 13 show how toner is moved for respective potentials of first processing unit 100*a*, photosensitive drum 1*a*, developing roller 37*a* and transfer unit 9*a*.

Figure 5:
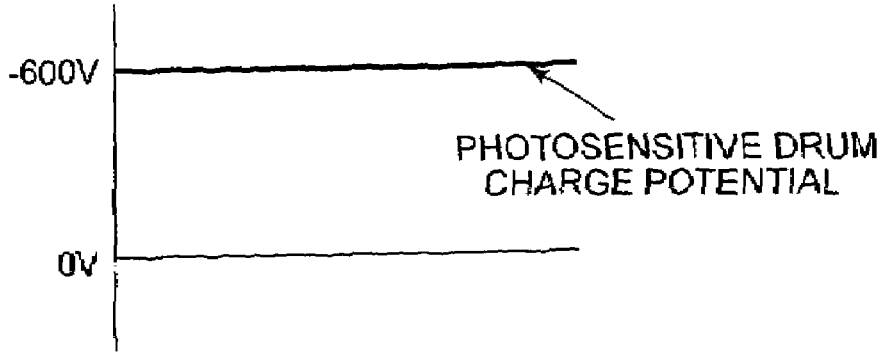
FIG. 5 is a first graph showing a photosensitive drum, a developing roller, potential of a transfer unit, and movement of toner.

When photosensitive drum 1*a* begins to rotate in first processing unit 100, the surface of photosensitive drum 1*a* is charged uniformly by main charger 3*a*. This charge voltage is about −600V in this embodiment (FIG. 5).

Figure 6:
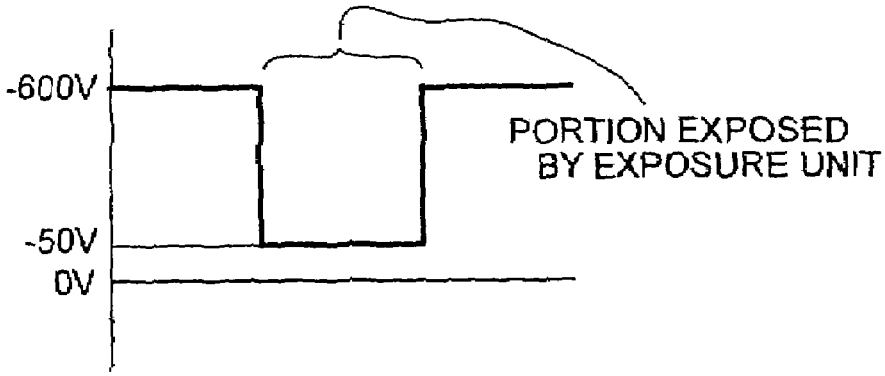
FIG. 6 is a second graph showing a photosensitive drum, a developing roller, potential of a transfer unit, and movement of toner.

When photosensitive drum 1*a* is rotated and the charged portion of the surface of photosensitive drum 1*a* is faced to exposure unit 5*a*, the surface of photosensitive drum 1*a* is exposed by exposure unit 5*a* and an electrostatic latent image is formed thereon based on an yellow image data. The potential of this electrostatic image portion is about −50V in this embodiment (FIG. 6).

Figure 7:
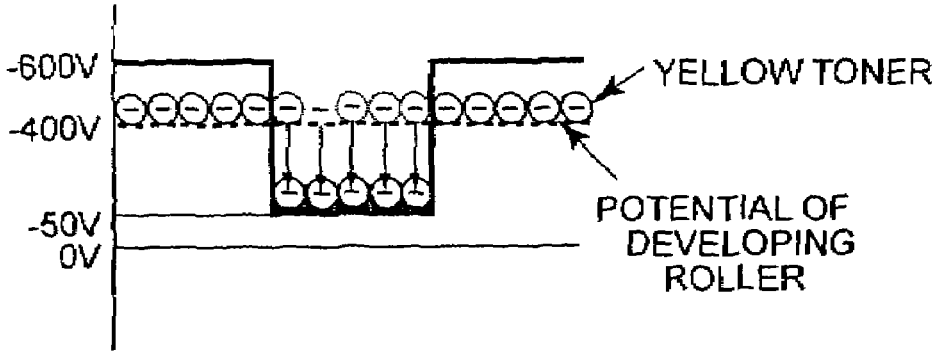
FIG. 7 is a third graph showing a photosensitive drum, a developing roller, potential of a transfer unit, and movement of toner.

When photosensitive drum 1*a* is rotated and the charged portion of the surface of photosensitive drum 1*a* is faced to developing device 7*a*, an electrostatic latent image formed on the surface of photosensitive drum 1*a* is developed by developing device 7*a* to a toner image in yellow system toner that is sufficiently minus charged in advance in developing device 7*a*. In this embodiment, bias voltage is applied to developing roller 37*a* and potential becomes about −400V (FIG. 7).

Figure 8:
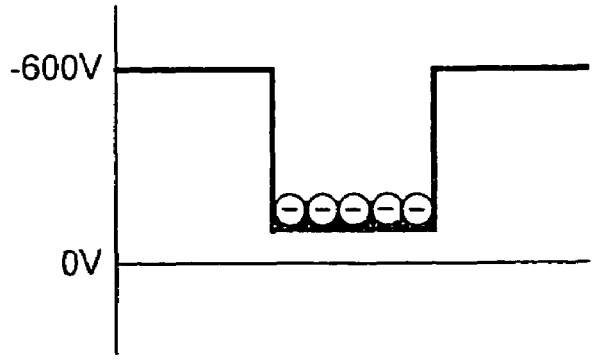
FIG. 8 is a fourth graph showing a photosensitive drum, a developing roller, potential of a transfer unit, and movement of toner.

Toner is moved from developing device 7*a* to the portion of photosensitive drum 1*a* exposed by exposure unit 5*a* and remained thereon (FIG. 8).

Figure 9:
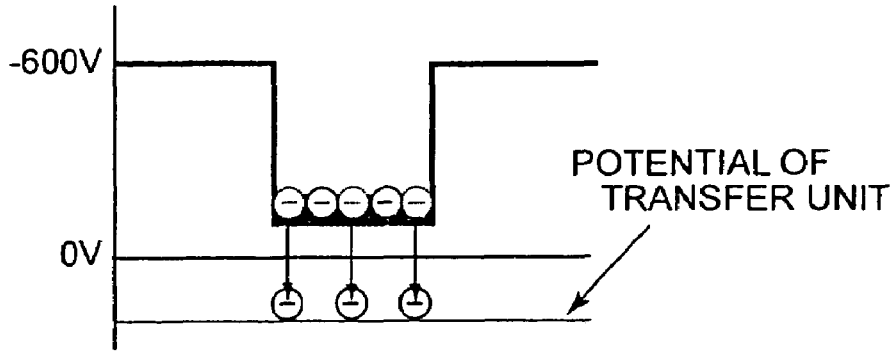
FIG. 9 is a fifth graph showing a photosensitive drum, a developing roller, potential of a transfer unit, and movement of toner.
Figure 10:
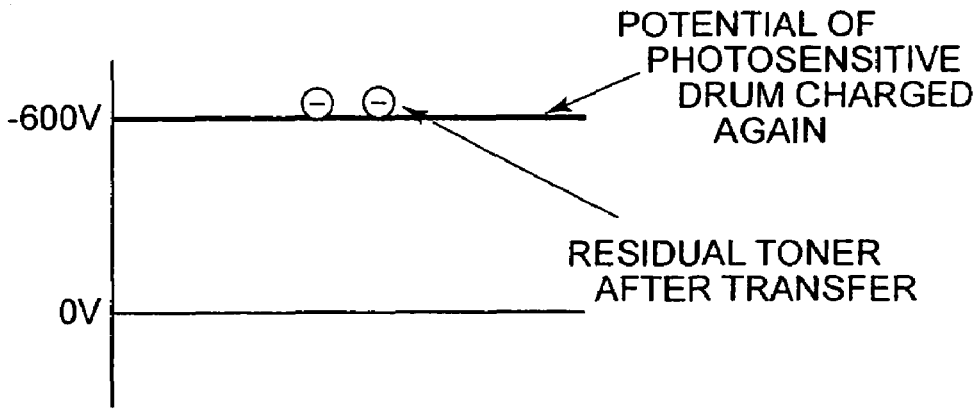
FIG. 10 is a sixth graph showing a photosensitive drum, a developing roller, potential of a transfer unit, and movement of toner.

When photosensitive drum 1*a* is rotated and conveyor belt 13 is rotated and is faced to a paper arrived to a specified position, transfer current is flown to transfer unit 9*a*. Then, an electric field is formed between transfer unit 9*a* and photosensitive drum 1*a* and a toner image formed on the surface of photosensitive drum 1*a* is transferred on a paper passing between transfer unit 9*a* and photosensitive drum 1*a* by this electric field (FIG. 9).

Figure 11:
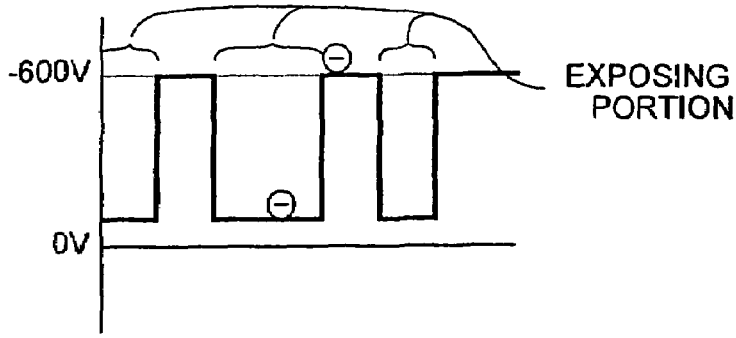
FIG. 11 is a seventh graph showing a photosensitive drum, a developing roller, potential of a transfer unit, and movement of toner.

The portion of photosensitive drum 1*a* with toner adhered and not transferred on a paper is charged again by main charger 3*a* (FIG. 10), exposed by exposure unit 5*a* and an electrostatic latent image is formed (FIG. 11).

Figure 12:
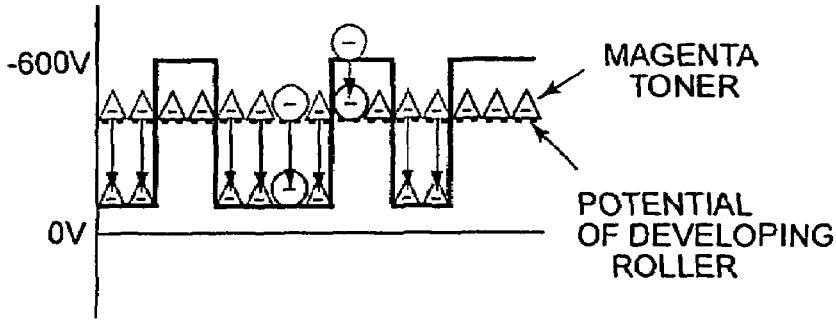
FIG. 12 is an eighth graph showing a photosensitive drum, a developing roller, potential of a transfer unit, and movement of toner.
Figure 13:
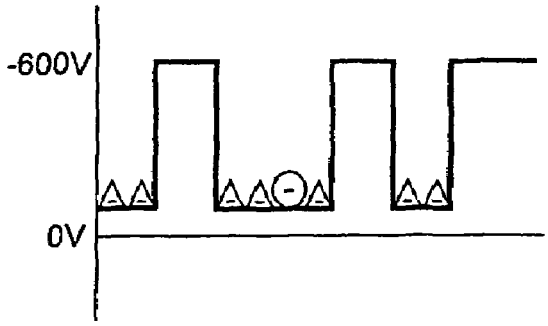
FIG. 13 is a ninth graph showing a photosensitive drum, a developing roller, potential of a transfer unit, and movement of toner.

When developing device 7*a* develops this electrostatic latent image, photosensitive drum 1*a* is charged to about −50V at the electrostatic latent image forming portion and about −600V at the non-forming portion and therefore, toner moves from developing roller 37*a* charged to about −400V to the electrostatic latent image forming portion of photosensitive drum 1*a* and on the other hand, toner moves from the electrostatic latent image non-forming portion to developing roller 37*a* (FIG. 12). As a result, residual toner on photosensitive drum 1*a* is collected to developing device 7*a* and toner is given to the electrostatic latent image formed on photosensitive drum 1*a*. This is the cleaner-less process (FIG. 13).

Such a processing is executed in second~fourth processing units 100*b* to 100*d* and magenta, cyanic and black toner images are superposed on a sheet on which a yellow toner image is formed by first processing unit 100*a*.

In first processing unit 100*a*, there is a problem generated in the process to form images, wherein paper dust on paper is reverse transferred on photosensitive drum 1*a* and collected in developing device 7*a* jointly with toner left on the surface of photosensitive drum 1*a* without transferred on paper and as a result, paper dust is mixed in developer in developing device 7*a*.

In first processing unit 100*a*, in order to decrease density of developer containing mixed paper dust, developer in developing device 7*a* is discharged through developer vent 43*a* and fresh developer is replenished into developer container 33*a* through developer replenishing port 47*a*.

Toner density of developer contained in developer container 33*a* is monitored by toner density detector 49*a*. When the image forming is carried out successively and toner density of developer in developer container 33*a* drops to below a specified level, developer in toner density higher than the above-mentioned specified density containing not only toner but also carrier is replenished until developer in developer container 33*a* becomes a specified toner density. Developer in developer container 33*a* increased by the amount of developer newly replenished is discharged through developer vent 43*a*.

In second to fourth processing units 100*b* to 100*d* to superpose toner images developed respectively on a paper having an image formed in first processing unit 100*a*, not only paper dust but also other color toners from toner images previously formed on the paper are inversely transferred and mixed in developers in developer containers 33*b* to 33*d*. As a countermeasure against this, developers are replenished and discharged likewise first processing unit 100*a*.

Thus, by replenishing new developers into developer containers and discharging old developers, it becomes possible to lower density of paper dust and other color toners mixed into developers in developer containers and successively form clear images.

To replenish not only toner but also developer comprising toner and carrier through the developer replenishing port, it is only necessary to connect only a cartridge containing a developer to the developer replenishing port. However, in order to increase toner density of developer in the developer container, it is necessary to discharge developer through the developer vent and is uneconomical because developers must be discharged even when amounts of paper dust and other color toners mixed in developer are less or when carrier is less damaged. So, cartridges containing toner and carriers, respectively may be provided and amount of toner or carrier supplied from these cartridges may be independently controlled.

Next, the method to discharge developer of the developing device will be described.

The control to replenish a developer of high toner density and discharge developer by the amount of added developer based on the toner density in the developer container is as described above. In addition to this, for example, after forming an image having relatively wide white portion, it is better to make the replenishing and discharge of developer. When an image having a wide white portion is formed, amount of paper dust mixed into the developer container relatively increases and it is therefore to discharge mixed paper dust.

Furthermore, it is better to replenish and discharge developer according to the number of sheets to form images. For example, when images having a low printing rate are frequently formed in first processing unit 100*a* at the upstream, even when paper dust is taken in developer container 33*b* from paper surfaces and accumulated there, toner density not much drop in developer containers 33*b* and developer may not be discharged in second processing unit 100*b*. In third to fourth processing units 100*c* to 100*d*, the similar phenomena may be generated and to avoid this, it may be advisable to replenish a specified amount of developer and to discharge developer by the increased amount after the image formation is made for a specified number of sheets. Thus, it becomes possible to solve such a problem that developer is not discharged even when paper dust is mixed.

In addition to the above-mentioned construction to discharge developer through the developer vent, it may be better to consume and discharge toner by developing an electrostatic latent image of 100% of printing ratio; that is a solid electrostatic latent image formed on photosensitive drum.

This is economical because paper dust and toner only can be discharged while leaving carrier contained in developer in a developer container.

A solid toner image can be formed anytime other than an ordinary image forming timing; that is, at other than non-printing operation. For example, a solid image may be formed immediately after completing the image formation based on image data sent from controller 103 and before starting the image formation based on next image data.

When executing the image formation successively for many sheets, it may be performed after completing a series of image forming operations. Or, the operations may be so controlled that a series of image forming operations are interrupted on the way and restarted after cleaning developer by forming a solid toner image.

Solid toner images formed here may be checked for defects by transferring on paper as an image receiving medium. However, if no confirmation is required, paper is wasted and therefore, using conveyor belt 13 as an image receiving medium, the solid toner image may be transferred on conveyor belt 13 and toner may be recovered with a belt cleaner.

In this embodiment, an image forming apparatus in the structure to transfer toner images on sheets of paper conveyed by conveyor belt 13 directly from first to fourth processing units 100*a* to 100*d* is described. This invention, however, may be applicable to an apparatus in such a structure that toner images in respective colors are superposed on an intermediate image receiving medium and transferred on sheets of paper on the conveyor belt. In this case, solid toner images transferred on the intermediate image receiving medium may be removed by a means to clean the intermediate image receiving medium or further transferred to a sheet of paper or the conveyor belt from the intermediate image receiving medium.

Next, a second embodiment will be described. Here, the second embodiment will be explained taking developing device 7*a* as an example but needless to say, this is also applicable to developing devices 7*b* to 7*d*.

Figure 16:
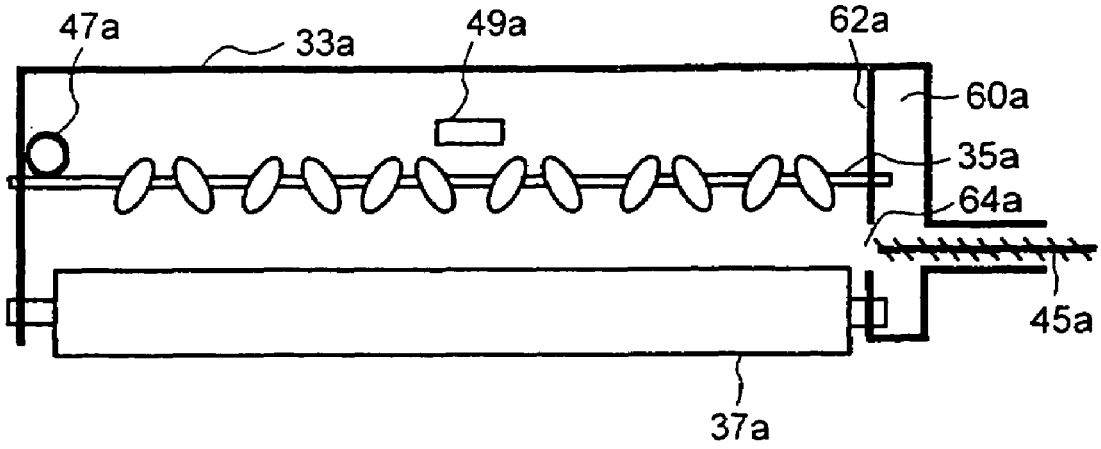
FIG. 16 is a rough sectional view of a developing device provided with a developer pool portion.

In this embodiment, a developer pool portion 60*a* as shown in FIG. 16 is provided near developer vent 43*a* of developing device 7*a* to regulate amount of developer discharged from developer vent 43*a*. Thus, it becomes not required to control a rotating angle of auger 45*a*.

Between developer container 33*a* and developer pool portion 60*a*, a partition 62*a* is provided and a connecting port 64*a* is provided at a specified position of partition 62*a* to connect developer container 33*a* and developer pool portion 60*a*. Connecting port 64*a* is provided at a height of the surface of developer contained in developer container 33*a*. Developer exceeding the specified surface height enters into developer pool portion 60*a* from developer container 33*a* and is discharged through developer vent 43*a* by auger 45*a*.

When the structure is as described above, it is not necessary to control the operation of auger 45*a* so as to maintain the amount of developer in developer container 33*a* at a fixed level and the construction becomes simple.

Figure 17:
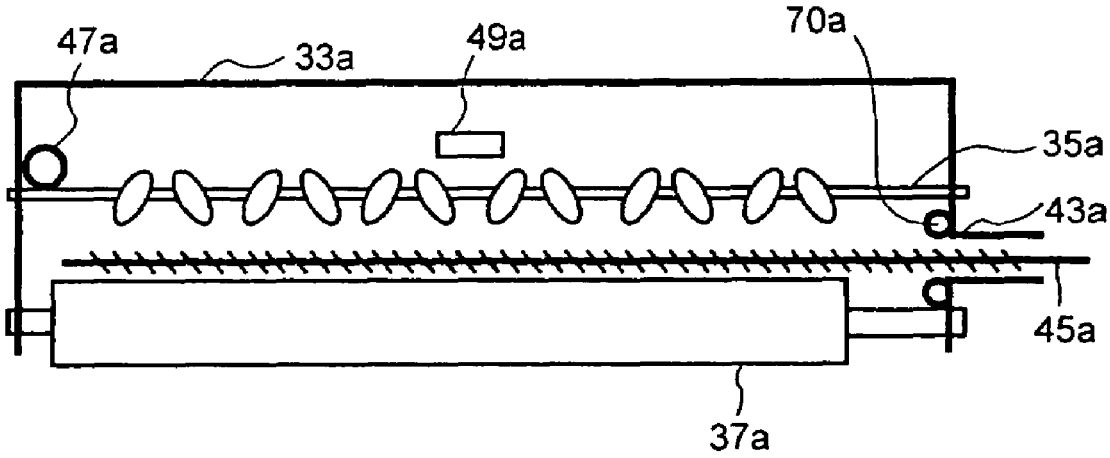
FIG. 17 is a rough section view of a developing device provided with a magnetic seal at the developer vent.

Another modification of the developing device will be described taking developing device 7*a* as an example. In this modification, a magnetic seal 706 is provided near developer vent 43*a* as shown in FIG. 17.

If mixed color developers are much in developer container 33*a*, even when developers are replenished and discharged as well as paper dust is sufficiently reduced, mixed developers are still much. In this case, it is more economical to discharge toner only without discharging carrier. Therefore, when magnetic seal 70*a* composed of magnet/electromagnet is used, carrier composed of magnetic materials are not discharged from developer vent 43*a* but mixed non-magnetic toner only is discharged from developer vent 43*a*. When magnetic seal 70*a* is composed of electromagnet, it is possible to select whether both of toner and carrier are discharged or toner only is discharged by turning on/off current to the electromagnet by considering toner density and carrier life in developer container 33*a*. Further, a discharging ratio of toner and carrier can be varied according to size of current.

Magnetic seal 70*a* may be provided at connecting port 64*a* when developer pool portion 60*a* is provided.

In addition to the replenishing and discharging of developer according to toner density of developer in the developer container, if the developer was discharged in a specified amount temporarily when the number of sheets with images formed reaches to a certain level, developer is exchanged periodically and deterioration of developer can be avoided even when a printing ratio is low.

THIRD EMBODIMENT

In the third embodiment, an amount of toner containing paper dust and other color toners mixing into second to fourth processing units 100*b* to 100*d* is decided based on a difference between a toner area formed by an upstream processing unit and a toner image area formed by it's own.

This will be explained taking second processing unit 100*b* as an example. First, a area of a toner image formed in first processing unit 100*a*. This area may be obtained by directly taking a picture using a CCD or other means and also, from an electrostatic latent image formed on photosensitive drums 1*b* to 1*d*.

A area of a toner image that is to be formed in second processing unit 100*b* is obtained from a area of an electrostatic latent image drawn by exposure unit 5*b* on photosensitive drum 1*b*.

As an area of toner images formed by first processing unit 100*a* is wider, toner to get into second processing unit 100*b* of a developing device increases more in quantity. In portions where toner images made by first processing unit 100*a* and those made by second processing unit 100*b* are overlapped, the former is prevented from reverse image transfer to photosensitive dram 1*b* of second processing unit 100*b* by the latter so that no toner gets into second processing unit 100*b* of the developing device.

Thus, the overlapped area is subtracted from the area of toner images formed by first processing unit 100*a* to estimate quantity of toner which gets into second processing unit 100*b* and toner are replenished to or discharged from second processing unit 100*b* immediately after the images are formed in the case that the estimated quantity of toner is above a predetermined value.

Thus, even when a large amount of other color toners may possibly be mixed into the developing device, it becomes possible to replenish or discharge developer immediately after other color toners mixed so as to prevent next image forming from being affected by mixing of other colors.

FOURTH EMBODIMENT

In the fourth embodiment, a high density toner image such as a solid image is developed on the photosensitive drum when an image is not formed and mixed color toners are carried out efficiently in addition to the discharging of developer by a relevant processing unit itself based on a toner density.

At this time, for example, when toner is discharged after forming a solid image in second processing unit 100*b*, in third processing unit 100*c* and fourth processing unit 100*d* at the downstream side, toner is transferred inversely to photosensitive drums 1*c* and 1*d* from a toner image formed in second processing unit 100*b*. In order to prevent this, the reverse transfer of toner is suppressed by reducing transferring current given to transfer units 9*c* and 9*d* of third processing unit 100*c* and fourth processing unit 100*d* when forming a solid mage for the purpose of discharging toner in second processing unit 100*b*.

Thus, the color toner mixing to third and fourth processing units 100*c* and 100*d* by discharging toner from second processing unit in the mixed color toner discharging mode can be prevented. Further, the discharged toner is removed by belt cleaner 16.

FIFTH EMBODIMENT

Some of toners transferred inversely from a first formed toner image may be in the negatively charged state. In the fifth embodiment, a mechanism to prevent negatively charged inversely transferred other color toners from mixing in the developing device will be described.

Figure 18:
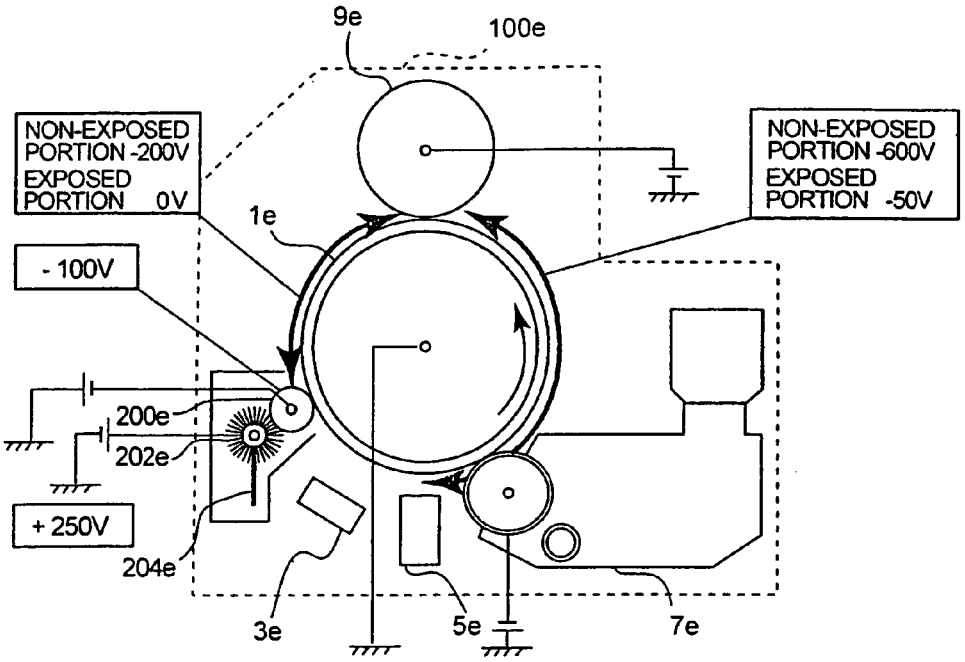
FIG. 18 is a rough sectional view showing a processing unit provided with a toner removing mechanism comprising an elastic roller, a brush roller and a contact member.

In this embodiment, a processing unit 100*e* shown in FIG. 18 will be used for second processing unit 100*b* shown in FIG. 1.

Processing unit 100*e* is composed of a photosensitive drum 1*e*, a main charger 3*e*, an exposure unit 5*e*, a developing device 7*e*, a transfer unit 9*e*, an elastic roller 100*e*, a brush roller 102*e*, and a contract member 204*e*.

Elastic roller 200*e* applied with voltage of about −199V is kept in contact with photosensitive drum 1e between the transfer position and the charging position of photosensitive drum 1*e* as shown in FIG. 18. Further, brush roller 202*e* applied with +250V is brought in contact with this elastic roller 200*e*.

Potential at the portion of photosensitive drum 1*e* charged at −600V by main charger 3*e*, where an electrostatic latent image is formed by exposing the image with exposure unit 5*e* becomes about −50V. Here, a toner that is negative charged is supplied from developing device 7*e* and the image is developed to a toner image and transferred onto a sheet of paper by transfer unit 9*e*. The potential of photosensitive drum 1*e* after the toner image was transferred on a sheet of paper is about −200V at the non-exposed portion and 0V or positive at the exposed portion.

Negative charged toner out of inversely transferred toners is attached to −100V voltage applied elastic roller 200*e* from the non-exposed portion. Remaining toner is left on the exposed portion. This toner was inversely transferred from a toner image transferred on a sheet of paper from photosensitive drum 1*e* itself and can be recovered by developing device 7*e* and is not needed to be removed by elastic roller 200*e*. The toner inversely transferred from other portions than that portion covered by a toner image formed in processing unit 100*e* is other color toner inversely transferred from a toner formed before and this toner only is removed by elastic roller 200*e*.

The inversely transferred toner attached to elastic roller 200*e* is removed with a brush roller 202 applied with +250V and will never be attached to photosensitive drum 1*e* again.

Here, elastic roller 200*e* was brought to contact with photosensitive drum 1*e*. However, this contact member 204*e* can be a brush if toner can be thoroughly removed from photosensitive drum 1*e*.

Thus, as an inversely transferred toner retaining means like elastic roller 200*e* is provided, it becomes possible to prevent color mixing because negative charged inversely transferred tone does not enter into developing device 7*e* in a processing unit using the cleaner-less processing.

Toner attached to brush roller 202*e* can be removed by providing a contact member 204*e* at the position contacting brush roller 202*e* as shown in FIG. 18.

Figure 19:
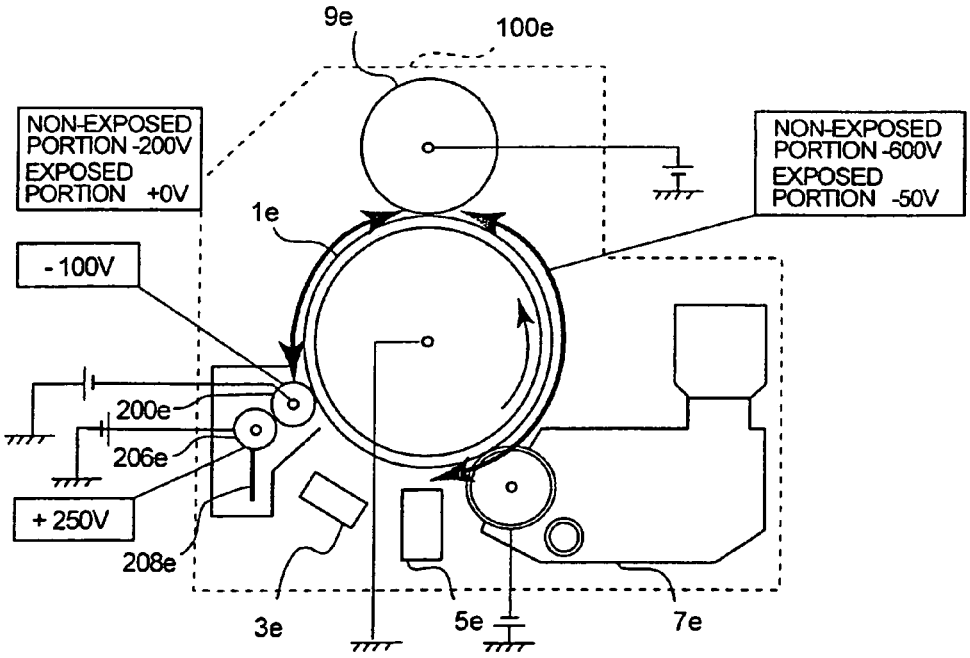
FIG. 19 is a rough sectional view of a processing unit provided with a toner removing mechanism comprising an elastic roller, a removing roller and a removing blade.

Further, a removing roller 206*e* may be provided for brush roller 202*e* and a removing blade 202*e* may be brought in contact with removing roller 206*e* as shown in FIG. 19. Thus, it becomes possible to further extend the service life than a combination of brush roller 202*e* with contact member 204*e*.

Figure 20:
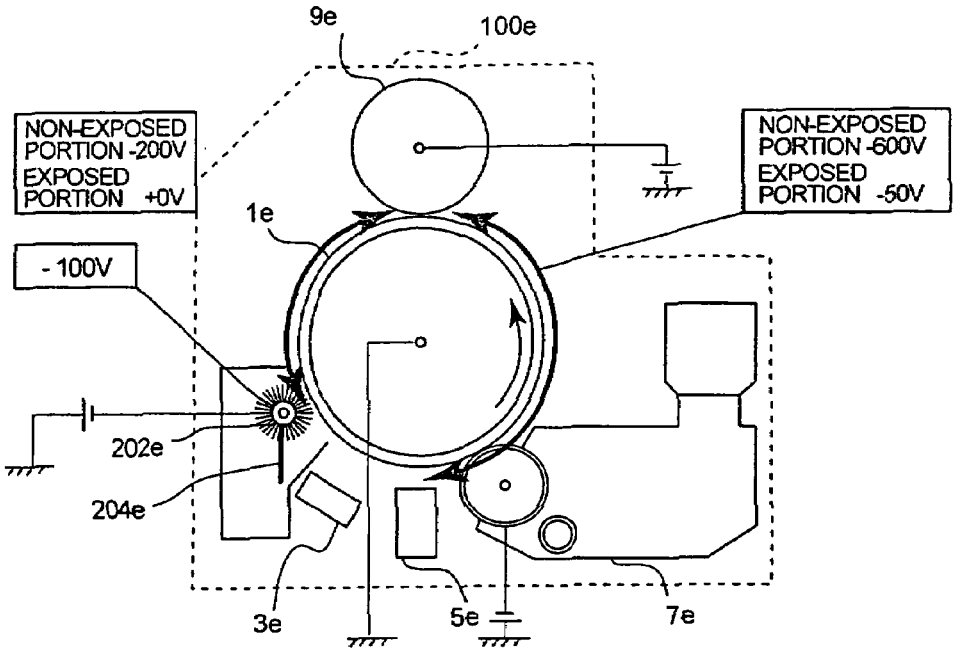
FIG. 20 is a rough sectional view showing a processing unit provided with a toner removing mechanism comprising a brush roller and a contact member.

Brush roller 202*e* applied with −100V voltage may be brought in contact with photosensitive drum 1*e* without providing elastic roller 200*e* as shown in FIG. 20.

Figure 21:
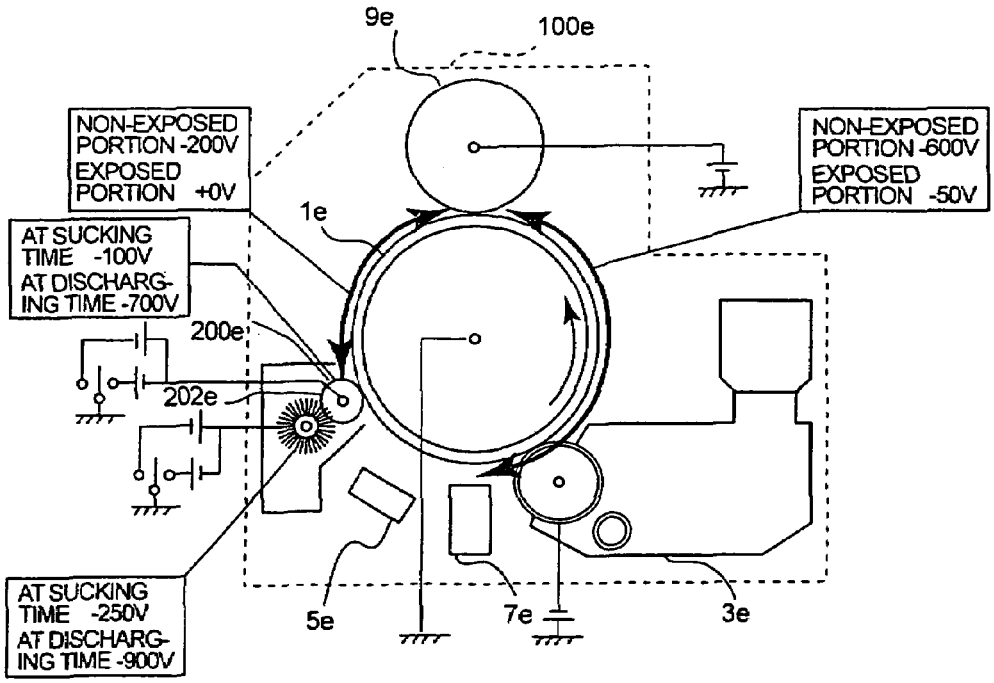
FIG. 21 is a rough sectional view showing a processing unit provided with a toner removing mechanism comprising an elastic roller and a brush roller.
Figure 22:
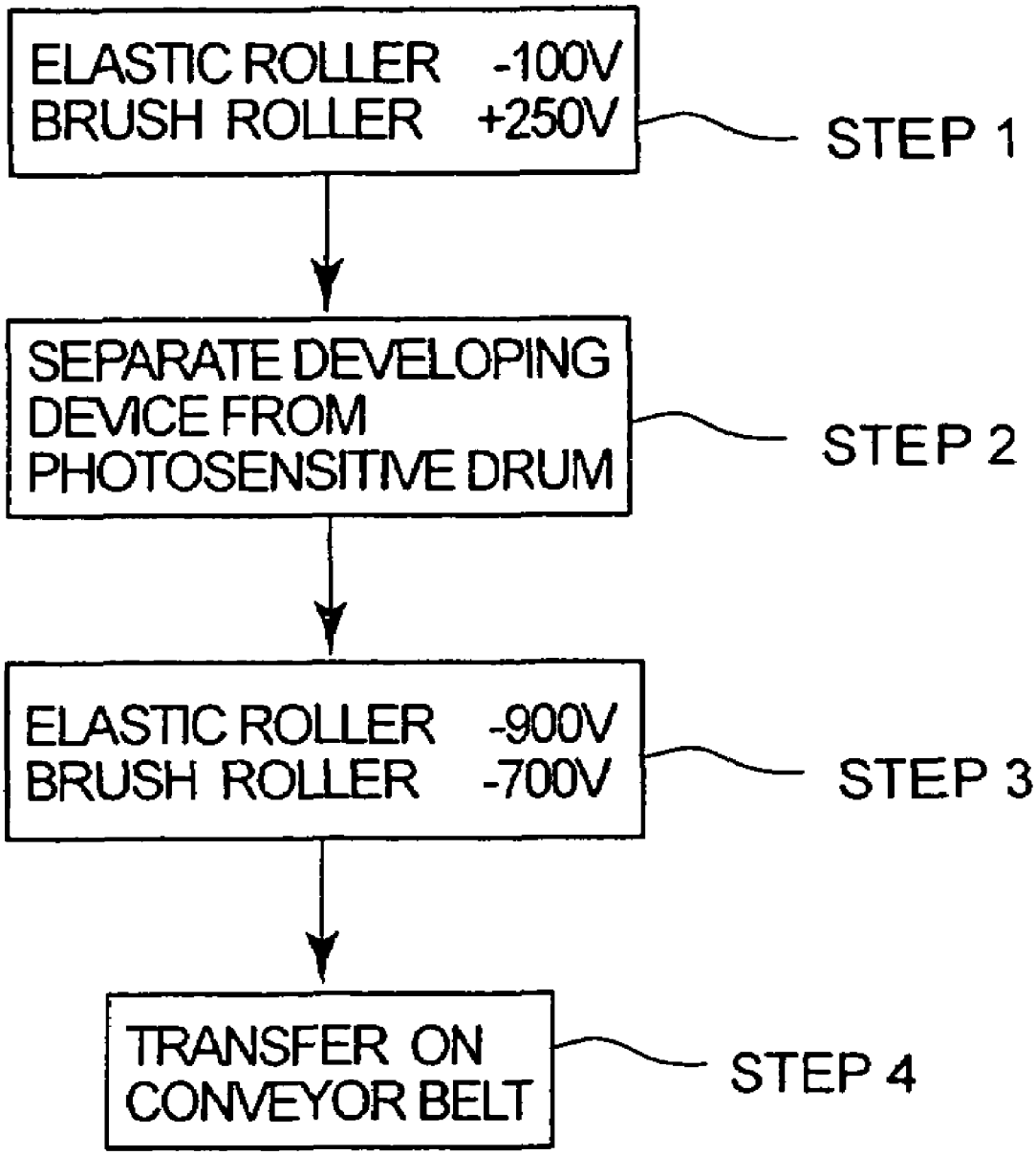
FIG. 22 is a flowchart of the voltage control to remove toner adhered to a brush roller.

The structure shown in FIG. 21 is less contact member 204*e* differing from the structure shown in FIG. 18. The apparatus is so controlled that toners attached to brush roller 202*e* is removed by varying voltage applied to brush roller 202*e* and elastic roller 200*e* without bringing contact member 204*e* in contact with brush roller 202*e*. This control will be explained referring to FIG. 22.

Inversely transferred toner is removed by bringing elastic roller 200*e* applied with −100V voltage in contact with photosensitive drum 1*e*. Voltage applied to brush roller 202*e* at this time, is +250V (Step 1).

When it is desired to remove toner attached to brush roller 202*e*, first separate developing device 7*e* from photosensitive drum 1*e* so that a developing roller 37*e* does not recover toner from photosensitive drum 1*e* (Step 2).

Then, applied voltage to brush roller 202*e* is varied to −900V and −700V voltage is applied elastic roller 200*e* (Step 3).

Toner retained on brush roller 202*e* is moved to elastic roller 200*e* and toner on elastic roller 200*e* is discharged to photosensitive drum 1*e*.

The discharged toner is transferred on conveyor belt 13 from photosensitive drum 1*e* and this toner is removed by belt cleaner 16.

By controlling the apparatus in this way, it becomes unnecessary to bring contact member 204 into contact with brush roller 202*e* and a long service life can be maintained.

As described above, when the cleaner-less process and developer discharging are used in combination, it is possible to maintain the less consumption of toners and prevent deterioration of developer without reducing the life of photosensitive drum 1*a*.

(Tests)

With the developing device in the first embodiment incorporated into a first processing unit 100*a*, an test shown below was conducted.

Under the environment of temperature 21° C. and humidity 50%, a developer 2009 of toner density of 75 wt % was put in developer container 33*a*. Bias current applied to transfer unit 9*a* was set at 10 μA.

The printing rate indicating a rate of an actually formed toner image area against the maximum toner image area that can be formed by this image forming apparatus on one sheet of A4 paper was set at 5% and an test was conducted on a case when auger 45*a* was operated and a case when an auger 45*a* was stopped; that is, when developer is discharged through developer vent 43*a* and when developer is not discharged. When developer was discharged, developer was replenished through developer replenishing port and when not discharged, toner only was replenished and amount of developer in developer container 33*a* was kept at a constant level. In order to compare a means to remove residual toner attached to photosensitive drum 1*a* with a means adopting a cleaner-less processing as in this embodiment, an embodiment was also conducted for a case when a cleaner 12*a* to scrape residual toner off photosensitive drum 1*a* is installed.

To observe the image status changing every time when an image was formed, the image formation was made on 10,000, 20,000, 30,000 and 40,000 sheets of A4 size paper and each time the image state was visually judged. The results of this observation are shown in Table 1. Test No. 4 corresponds to developing device 7*a* in the first embodiment.

TABLE 1

| Test No. | Print Rate | Developer discharging | Cleaner | No. of printed sheets 10,000 | 20,000 | 30,000 | 40,000 | Toner consumption |
|---|---|---|---|---|---|---|---|---|
| 1 | 5% | Stop | Yes | ○ | ○ | X | | 20 g/1,000 sheets |
| 2 | | | No | ○ | X | | | 17 g/1,000 sheets |
| 3 | | Operate | Yes | ○ | ○ | ○ | ○ | 30 g/1,000 sheets |
| 4 | | | No | ○ | ○ | ○ | ○ | 25 g/1,000 sheets |

X: Fogging generated

At the point of time when the image forming on 20,000 sheets under the condition of Test No. 2 using the cleaner-less processing without discharging developer through developer vent 43*a*, the image fogging was generated. Also, under the condition of Test No. 1 with cleaner 12*a* installed without discharging developer, the image fogging was generated at the point of time when the image forming of 30,000 sheets was completed.

On the contrary, when developer was discharged, the image deterioration shown above was not recognized when the image formation on 40,000 sheets of paper was completed under either the condition in Test No. 4 of the cleaner-less processing or the condition in Test 3 with cleaner 12*a* installed.

Figure 15:
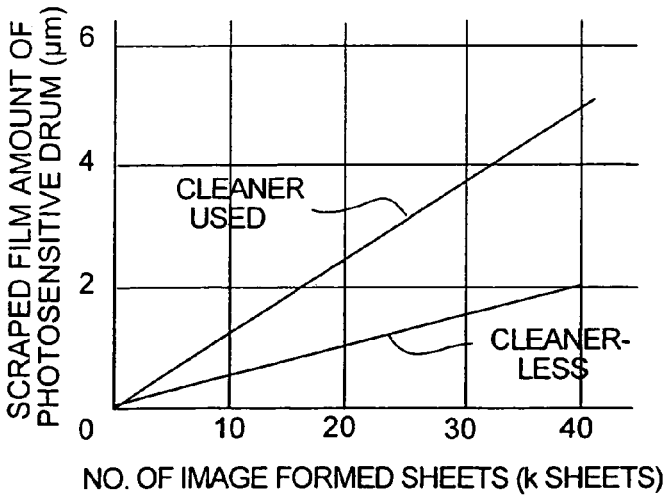
FIG. 15 is a graph showing the relation between scraping amount of the photosensitive drum surface and the number of forming images.

When the toner consumption shown in Table 1 under the condition in Test No. 3 was compared with that under the condition in Test No. 4, the toner consumption under the condition in Test No. 4 with the cleaner-less process adopted was less. Further, as clearly seen in FIG. 15 showing the comparison results of scraping amounts of the surface of photosensitive drum 1*a* for availability of cleaner 12*a*, the scraping amount of the surface of photosensitive drum 1*a* can be made less when the cleaner-less processing was adopted and the life of photosensitive drum 1*a* can be extended.

Accordingly, when the cleaner-less processing was used to discharge developer by providing developer vent 43*a* to developer container 33*a*, toner consumption can be maintained at the low level and deterioration of developer can be prevented without reducing the life of photosensitive drum 1*a*.

(Test 2)

In the first embodiment, the printing rate was set as low as 1% and frequency of developer discharging based on toner density in developer container 33*a* was reduced. Under this state, developer was replenished and discharged according to toner density of developer in developer container 33*a*. The results of this test are shown as Test No. 5.

Figure 14:
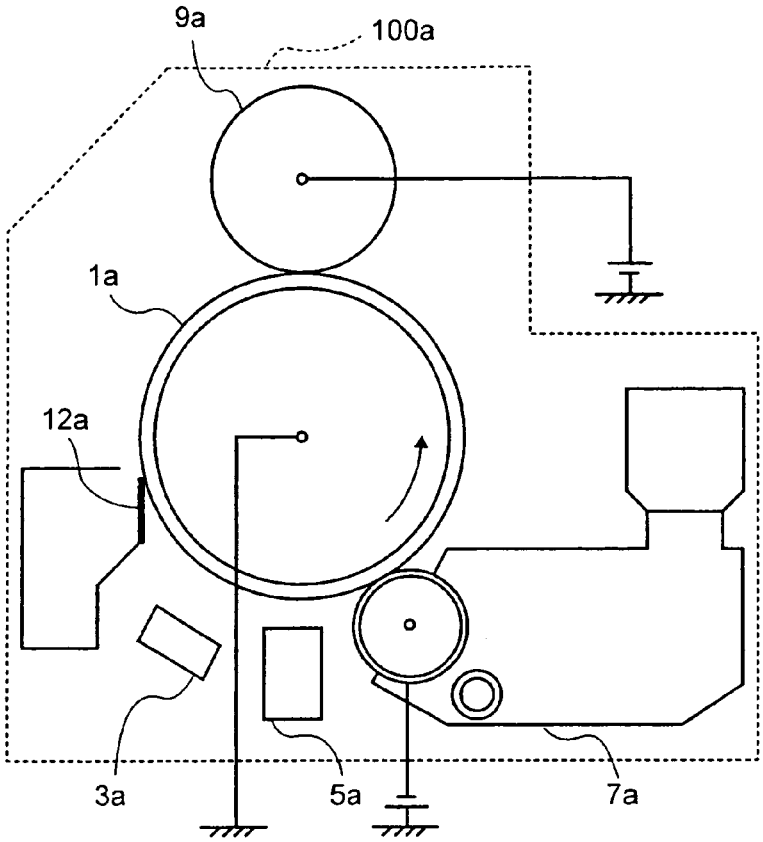
FIG. 14 is a rough sectional view showing a processing unit equipped with a cleaner.

Further, the test results conducted with cleaner 12*a* installed for scraping off residual toner on photosensitive drum 1*a* as shown in FIG. 14 are shown as Test No. 6. In Test No. 7, paper powder and dust were discharged by executing the solid image formation of 100% printing rate for one A4 size sheet of paper for the image forming of every 50 sheets and toner was replenished through developer replenishing port 47*a*. In Test No. 8 corresponding to the developer discharging method explained in the first embodiment, developer was discharged through developer vent 43*a* for every image forming of 100 sheets and the same amount of developer was replenished through developer replenishing port 47*a*. The results of this test are shown in Table 2.

TABLE 2

| Test No. | Print Rate | Developer discharging | Cleaner | No. of printed sheets 10,000 | 20,000 | 30,000 | 40,000 | Interim discharge |
|---|---|---|---|---|---|---|---|---|
| 5 | 1% | Operate | No | ○ | X (A) | | | |
| 6 | | | Yes | ○ | ○ | ○ | X (B) | |
| 7 | | | No | ○ | ○ | ○ | ○ | Solid print 50 sheets |
| 8 | | | Yes | ○ | ○ | ○ | ○ | 1 g/100 sheets |

X: Fogging generated

In Test No. 5 wherein developer was replenished or discharged according to only toner density of developer in developer container 33*a*, the image fogging was already recognized at the point of time when the image forming was completed on 20,000 sheets. Under the condition in Test No. with cleaner 12*a* provided, the image fogging was generated for deterioration of developer at the time when the image forming was completed on 30,000 sheets.

Under the condition in Test No. 7 wherein a solid image was formed for the image forming of every 50 sheets, no improper image formation was resulted even when the image formation of 40,000 sheets was completed.

Further, under the conditions of Test No. 8 wherein developer was replenished/discharged for every 100 sheets, defective image forming was not resulted when the image forming of 40,000 sheets was complete. It is considered that more high effect is obtained when the solid image forming is combined with the developer replenishing and discharging.

As described above, when developer is not only replenished/discharged according to its density in developer container 33*a* but also is discharged in a specified amount temporarily when a number of sheets with an image formed reaches a certain level, developer is exchanged periodically and therefore, it becomes possible to maintain developer unchanged without deteriorated even when a printing rate is low.

(Test 3)

The test was conducted by operating first processing unit 100*a* and second processing unit 100*b* as shown below.

An yellow toner image was formed on paper with first processing unit 100*a* by changing a printing rate to 3%, 5% and 10%. Further, the printing pattern of a magenta image that is formed with second processing unit 100*b* was adjusted to the printing rate 5% so that it does not overlapped on the toner image formed on paper by first processing unit 100*a*. Further, the similar test was also conducted for a case when developer was discharged in processing unit 100*b* at the printing rate 10%.

Because a toner image formed by first processing unit 100*a* does not overlap on a toner image formed by second processing unit 100*b*, an amount of toner corresponding to the printing rate of first processing unit 100*a* is inversely transferred and mixes into toner in second processing unit 100*b*. On the other hand, in second processing unit 100*b*, toner is discharged as a toner image is formed on paper. Under these states, changes in color tone of an image formed on 5,000, 10,000 and 1,5000 sheets were observed. The results are as shown in Table 3.

TABLE 3

| | Printing rate | | | No. of printed sheets | | | |
|---|---|---|---|---|---|---|---|
| Test No. | 1st proces unit | 2nd proces unit | Developer discharging | 5,000 | 10,000 | 15,000 | 20,000 |
| 9 | 3% | 5% | Stop | ○ | ○ | Mixed Color | |
| 10 | 5% | | | ○ | Mixed Color | | |
| 11 | 10% | | | Mixed Color | | | |
| 12 | | | Operate | ○ | Mixed Color | | |

X: Fogging generated

In Test No. 9 wherein the developer discharge was stopped in second processing unit 100*b* and the printing rate was 3% in first processing unit 100*a*, the color tone change was confirmed at the 15,000th sheet. The color tone change was confirmed at the 10,000th sheet in Test No. 10 of the printing rate 5% and 5th sheet in Test No. 11 of the printing rate 10%. The more larger the toner image area formed in first processing unit 100*a* was, the more faster the color tone change appeared.

On the other hand, in Test No. 12 corresponding to the third embodiment; that is, when developer was discharged in second processing unit 100*b* and the printing rate in first processing unit 100*a* was 10%, no color tone change was observed until 10th sheet. From this result, it is seen that the color mixing of toner can be delayed when developer is discharged.

(Test 4)

In order to substantiate the fourth embodiment, the test shown below was conducted. Table 4 shows the change in transfer efficiency showing what % of toner on a toner image formed on a sheet of paper in first processing unit 100*a* corresponding to the transfer current of second processing *unit* 100*b* is inverse transferred to photosensitive drum 1*c* of third processing unit 100*c*.

TABLE 4

| | Printing rate | | | No. of printed sheets | | | |
|---|---|---|---|---|---|---|---|
| Test No. | 1st proces unit | 2nd proces unit | Developer discharging | 5,000 | 10,000 | 15,000 | 20,000 |
| 13 | 10 | 5% | Stop | ○ | ○ | Mixed Color | |
| 14 | | | | ○ | Mixed Color | | |
| 15 | | | | Mixed Color | | | |
| 16 | | | Operate | ○ | Mixed Color | | |

TABLE 4-continued

| Test No. | Printing rate 1st proces unit | Printing rate 2nd proces unit | Developer discharging | No. of printed sheets 5,000 | 10,000 | 15,000 | 20,000 |
|---|---|---|---|---|---|---|---|
| 17 | | | | | | | |
| 18 | | | | | | | |

X: Fogging generated

According to this, it can be seen that the inverse transfer of the first yellow color toner image or the inverse transfer form the second color magenta toner image was below 0.1% when transfer current is below 5 μA and single transferring toner amount can be made small by suppressing transfer current.

(Test 5)

The test shown below was conducted on the toner removing mechanism explained in the fifth embodiment as shown below using processing unit 100*e* shown in FIG. 18 instead of second processing unit 100*b* shown in FIG. 2. The printing rate of an yellow toner image that is formed on a sheet of paper in first processing unit 100*a* was set at 10%. Further, the print pattern of a magenta toner image that is formed in processing unit 100*e* is regulated so as to make the printing rate constant at 5% in processing unit 100*e* so that a magenta toner image is not overlapped on the toner image formed on a sheet of paper in first processing unit 100*a*. Under this state, the color tone change of images when formed on 5,000 sheets, 10,000 sheets and 15,000 sheets were observed. The results are as shown in Table 5.

TABLE 5

| Test No. | Printing rate 1st proces unit | Printing rate 2nd proces unit | Developer Discharging | Removing toner Structure of member | No. of printed sheets 5,000 | 10,000 | 15,000 | 20,000 |
|---|---|---|---|---|---|---|---|---|
| 13 | 10% | 5% | Stop | None | Mixed Color | | | |
| 14 | | | | Rotary brush + contact member | ○ | Mixed Color | | |
| 15 | | | | Elasticroller + Rotary brush + Removing blade | ○ | ○ | Mixed Color | |
| 16 | | | | Elasticroller + Rotary brush + Removing blade | ○ | ○ | ○ | Mixed Color |
| 17 | | | | Elasticroller + Rotary brush | ○ | ○ | ○ | Mixed Color |
| 18 | | | Operate | (Discharging brush) | ○ | ○ | ○ | ○ |

In Test No. 13 wherein no toner removing mechanism was provided, the mixed color was observed when completing the image forming on 5,000 sheets of paper while in Test No. 14 wherein the toner removing mechanism comprising brush roller 202*e* and contact member 204*e* as shown in FIG. 20 was provided, the mixed color was not conspicuous at that time. In Test No. 15 wherein elastic roller 200*e* was provided between brush roller 202*e* and photosensitive drum 1*e* as shown in FIG. 18, mixed color was not observed further until 10,000 sheets.

In Test No. 16, the toner was removed with removing roller 206*e* kept contacted to elastic roller 200*e* and removing blade 208*e* kept contacted to removing roller 206*e* as shown in FIG. 19, and no mixed color was confirmed until 15,000 sheets.

In Test No. 17, a test was conducted in the structure using elastic roller 200*e* and brush roller 202*e* and toner was removed from brush roller 202*e* without using contact member 204*e* but by controlling voltage applied to elastic roller 200*e* and brush roller 202*e* as shown in FIG. 21. Whenever the image forming was executed on 50 sheets of paper, voltage applied to elastic roller 200*e* and brush roller 202*e* was varied and toner was discharged for two rotations of photosensitive drum. In this test, the mixed color was not recognized until 15,000 sheets likewise Test No. 16. In Test No. 18 which combined Test No. 17 with the developer discharging based on toner density in developing device 7*e*, the mixed color was also not recognized at the point of time when the image forming on 20,000 sheets was completed.

When a toner removing mechanism described above is provided, it is possible to suppress the progress of color mixing even when the number of image forming sheets is increased.

In the above description, the configuration wherein processing units installed by aligning them in the conveying direction of sheets of paper conveyed by conveyor belt 13 was explained but it is not restricted to this, and needless to say, the present invention is also applicable to a configuration adopting an intermediate transferring element system to transfer an image once transferred to an intermediate transferring element again to sheets of paper collectively.

According to the present invention, it is possible to obtain an image forming apparatus capable of successively forming clear images by preventing deterioration of developer for mixture of paper dust and efficiently discharging mixed color toner in the color image formation.

Further, according to the present invention, it is possible to obtain an image forming apparatus capable of successively forming clear images by efficiently discharging mixed color toner and preventing mixture of toner.

In addition, according to the present invention, it is possible to obtain an image forming apparatus capable of successively forming clear images by preventing mixture of other color toners into a developing device and efficiently using toners.

What is claimed is:

1. An image forming apparatus comprising:

an image carrier;

a main charger to uniformly charge the image carrier;

an exposure unit to form an electrostatic latent image by exposing the image carrier charged by the main charger;

a developing device to form a toner image by developing the electrostatic latent image on the image carrier with two-component developer including toner and carrier, the developing device comprising:

a developer vent;

a developer replenishing port to replenish developer to the developing device;

a developer container to contain the developer;

a developer pool portion to once pool the developer over flown from the developer container and to be discharged;

a partition to divide the developer pool portion and the developer container; and a connecting port provided at a specified position of the partition and provided at a height of the surface of the developer contained in the developer container; and a transfer unit to transfer the toner image onto an image receiving medium, wherein the developing device removes residual toner remained on the image carrier after transferring the toner image by the transfer unit and discharges paper dust mixed into the developing device when removing the residual toner through the developer vent together with the carrier.

2. The image forming apparatus as set forth in claim 1, wherein the developing device has a magnetic seal at the developer vent.

3. The image forming apparatus as set forth in claim 1, wherein the developing device has a toner density detector to detect toner density of the developer, and discharges the developer through the developer vent based on the toner density detected by the toner density detector.

4. The image forming apparatus as set forth in claim 1, wherein the developing device discharges developer through the developer vent based on the number of sheets with an image formed.

5. The image forming apparatus as set forth in claim 1, wherein the developing device discharges developer through the developer vent based on an integrated value of a non-printed area.

6. An image forming apparatus comprising:

a first image carrier;

a first main charger to charge the first image carrier;

a first exposure unit to form a first electrostatic latent image by exposing the first image carrier charged by the first main charger;

a first developing device containing a first developer including a first toner and carrier and develops the first electrostatic latent image formed on the first image carrier with the first toner to form a first toner image;

a first transfer unit to transfer the first toner image onto an image receiving medium from the first image carrier;

a second image carrier;

a second main charger to charge the second image carrier;

a second exposure unit to form a second electrostatic latent image by exposing the second image carrier charged by the second main charger;

a second developing device, having a developer vent and a developer replenishing port, and containing a second developer including a second toner and carrier, to develop the second electrostatic latent image formed on the second image carrier with the second toner, wherein the second developing device removes the first and second toners adhered to the second image carrier from the second image carrier and discharges the removed first toner and the second developer with the second toner mixed through the developer vent; and a second transfer unit to transfer the second toner image developed by the second developing device onto the image receiving medium onto which the first toner image has already been transferred.

7. The image forming apparatus as set forth in claim 6, wherein the second developing device discharges developer based on a value obtained by subtracting an area of a portion wherein the first toner image and the second toner image are overlapped each other from the area of the first toner image.

8. The image forming apparatus as set forth in claim 6, wherein the second developing device forms an image in a non-printing operation and the second developing device discharges toner from the second developing device by transferring the image onto the image receiving medium.

9. The image forming apparatus as set forth in claim 8 further comprising a third transfer unit, provided at downstream side from the second transfer unit, to transfer a third toner image onto the image receiving medium onto which the first and second toner images have already been transferred, wherein the third transfer unit is applied a transfer current which is lower than the one at the time of normal image formation when the image receiving medium passes the third transfer unit.

10. An image forming apparatus comprising:

a first image carrier;

a first main charger to charge the first image carrier;

a first exposure unit to form a first electrostatic latent image by exposing the first image carrier charged by the first main charger;

a first developing device to develop the first electrostatic latent image formed on the first image carrier to form a first toner image with a first toner;

a first transfer unit to transfer the first toner image onto an image receiving medium from the first image carrier;

a second image carrier;

a second main charger to charge the second image carrier;

a second exposure unit to form a second electrostatic latent image by exposing the second image carrier charged by the second main charger;

a second developing device to develop the second electrostatic latent image formed on the second image carrier by the second exposure unit, wherein the second developing device removes the first toner and the second toner adhered to the second image carrier from the second image carrier and discharges the removed first toner and the second toner by forming a solid image on the second image carrier with the removed first toner and the second toner;

a second transfer unit to transfer the second toner image developed by the second developing device onto the image receiving medium on which the first toner image was already transferred from the first image carrier; and a third transfer unit, provided at downstream side from the second transfer unit, to transfer a third toner image onto the image receiving medium onto which its first and second toner images have already been transferred, wherein the third transfer unit lowers the transfer current when the second toner image transferred from the second image carrier passes between the third transfer unit and the third image carrier.

11. An image forming method comprising:

uniformly charging an image carrier;

forming an electrostatic latent image by exposing the charged image carrier;

forming a toner image by developing the electrostatic latent image using a two-component developer including toner and carrier by a developing device having a developer vent;

transferring the toner image onto an image receiving medium; and removing residual toner remaining on the surface of the image carrier after transferring the toner image and discharging paper dust mixed in the developing device when removing the residual toner together with a developer or the carrier through the developer vent, wherein the developing device:

contains the developer in a developer container;

pools the developer, which has over flown a partition, from the developer container into a developer pool portion; and discharges the developer mixing the paper dust through the developer vent.

12. The image forming method as set forth in claim 11, wherein the developing device does not discharge the carrier comprising a magnetic material from the developer vent by the magnetic seal provided to the developer vent.

13. The image forming method as set forth in claim 11, wherein the developing device:

detects toner density in the developer; and controls the developing device to discharge the developer through the developer vent based on the toner density.

14. The image forming method as set forth in claim 11, wherein the developing device discharges developer through the developer vent based on the number of image formed sheets of paper.

15. The image forming method as set forth in claim 11, wherein the developing device discharges developer through the developer vent based on an integrated value of non-printed areas.

16. An image forming method comprising:

charging a first image carrier;

forming a first electrostatic latent image by exposing the charged first image carrier;

forming a first toner image with the first toner by developing the first electrostatic latent image formed on the first image carrier by a first developing device containing a first developer including a first toner and carrier;

transferring the formed first toner image onto an image receiving medium from the first image carrier;

charging a second image carrier;

forming a second electrostatic latent image by exposing the charged second image carrier;

developing the second electrostatic latent image using a second toner by a second developing device having a developer vent and containing the second developer including the second toner and carrier;

removing the first toner and the second toner adhered to the second image carrier from the second image carrier;

discharging the second developer and the removed first toner through the developer vent; and transferring the second toner image developed by the second developing device from the second image carrier onto the image receiving medium on which the first toner image was already transferred.

17. The image forming method as set forth in claim 16, wherein the second developing device discharges the developer based on a value of an area of the first toner image subtracted an area of a portion where the first toner image and the second toner image are overlapped each other.

18. The image forming method as set forth in claim 16, wherein the second developing device forms an image when no printing is made and consumes the second toner by transferring the image onto the image receiving medium.

19. An image forming method comprising:

charging a first image carrier;

forming a first electrostatic latent image by exposing the charged first image carrier;

forming a first toner image using a first toner from the first electrostatic latent image by a first developing device;

transferring the first toner image onto an image receiving medium from the first image carrier;

charging a second image carrier;

forming a second electrostatic latent image by exposing the charged second image carrier;

forming a second toner image by developing the second electrostatic latent image by a second developing device, removing the first toner and the second toner adhered to the second image carrier therefrom, consuming the second toner mixing the first toner by forming a solid image on the second image carrier; and transferring the second toner image developed by the second developing device onto the image receiving medium on which the first toner image was already transferred from the first image carrier;

wherein a transfer of the second transfer unit is lower than that of the first transfer unit when the first toner image transferred from the first image carrier passes between the second transfer unit and the second image carrier.

20. An image forming apparatus comprising:

first charging means for charging a first image carrier;

first exposure means for forming a first electrostatic latent image by exposing the first image carrier charged by the first charging means;

first developing means containing a first developer including a first toner and carrier for developing the first electrostatic latent image formed on the first image carrier with the first toner to form a first toner image;

first transfer means for transferring the first toner image onto an image receiving medium from the first image carrier;

second charging means for charging a second image carrier;

second exposure means for forming a second electrostatic latent image by exposing the second image carrier charged by the second charging means;

second developing means, having a developer vent and a developer replenishing port, and containing a second developer including a second toner and carrier, for developing the second electrostatic latent image formed on the second image carrier with the second toner, wherein the second developing means removes the first and second toners adhered to the second image carrier from the second image carrier and discharges the removed first toner and the second developer with the second toner mixed through the developer vent; and second transfer means for transferring the second toner image developed by the second developing means onto the image receiving medium onto which the first toner image has already been transferred.

* * * * *